US006829864B2

(12) United States Patent
Mitchell et al.

(10) Patent No.: US 6,829,864 B2
(45) Date of Patent: Dec. 14, 2004

(54) THRESHOLD PROTECTIVE COVER WITH HINGE

(76) Inventors: John Robert Mitchell, 3211 Broad St., Suite 205, San Luis Obispo, CA (US) 93401; David Joseph Thum, 2609 El Cerrito St., San Luis Obispo, CA (US) 93401

( * ) Notice: Subject to any disclaimer, the term of this patent is extended or adjusted under 35 U.S.C. 154(b) by 0 days.

(21) Appl. No.: 10/339,438

(22) Filed: Jan. 7, 2003

(65) Prior Publication Data

US 2003/0126826 A1 Jul. 10, 2003

Related U.S. Application Data

(60) Provisional application No. 60/345,575, filed on Jan. 7, 2002.

(51) Int. Cl.[7] ..... E06B 1/34

(52) U.S. Cl. ..... 52/211; 52/204.5; 52/656.2; 52/656.4

(58) Field of Search ..... 52/204.5, 211, 52/656.2, 656.4

(56) References Cited

U.S. PATENT DOCUMENTS

| | | | | | |
|---|---|---|---|---|---|
| 1,543,034 | A | * | 6/1925 | Stevens | 49/70 |
| 1,966,402 | A | * | 7/1934 | Barringer | 52/181 |
| 2,872,714 | A | * | 2/1959 | Odegaard et al. | 49/469 |
| 4,224,766 | A | | 9/1980 | Procton | |
| 5,010,690 | A | | 4/1991 | Geoffrey | |
| 5,943,825 | A | * | 8/1999 | Procton et al. | 49/469 |
| 6,044,600 | A | * | 4/2000 | McCollough | 52/209 |
| 6,216,395 | B1 | | 4/2001 | Kelly | |
| 6,269,591 | B1 | | 8/2001 | Kelly | |

FOREIGN PATENT DOCUMENTS

| | | | |
|---|---|---|---|
| DE | EP-0419894 A2 | * | 9/1990 |
| GB | 2063341 A | * | 6/1981 |

* cited by examiner

*Primary Examiner*—Peter M. Cuomo
*Assistant Examiner*—Joseph Edell
(74) *Attorney, Agent, or Firm*—Law Office of Philip A Steiner

(57) ABSTRACT

A hinged protective cover for protecting a door threshold during construction or modification of a building or its contents. The cover is attached to a horizontal surface such as a building floor and covers the door threshold to prevent damage from foot traffic, contaminants and grit materials which may become lodged in the threshold. The hinge allows positioning of the protective cover to permit door closure while remaining attached to the floor. This leaves the cover in place for repositioning to the protecting position when the door is reopened and serves as an affirmative reminder to accomplish same.

18 Claims, 6 Drawing Sheets

THRESHOLD PROTECTIVE COVER WITH HINGE

CROSS-REFERENCE TO RELATED APPLICATIONS

This application is a non-provisional application claiming benefit and priority under 35 U.S.C. § 119(e) of U.S. provisional application No. 60/345,575, "Threshold Protector with Hinges," filed on Jan. 7, 2002 and herein incorporated by reference.

FEDERALLY SPONSORED RESEARCH AND DEVELOPMENT

Not Applicable.

REFERENCE TO A MICROFICHE APPENDIX

Not Applicable.

FIELD OF THE INVENTION

This invention relates to a structural protective device and more specifically to a protective cover for a door threshold for use during construction or modification of a building or its contents.

BACKGROUND OF THE INVENTION

Door thresholds include the portion of door frames that lies below a closed or sliding door and which often provides a sealing surface for the door. Damage to the threshold adversely affects the door seal, operability of sliding doors as well as aesthetics. Thresholds are installed for both hinged doors and sliding doors. During construction of a building, the doorways, doors and thresholds are installed relatively early in the construction process to protect the interior from the elements and prevent unauthorized access, theft and vandalism. However, during the construction process, there is a large amount of through traffic that flows across the door thresholds.

The through traffic inadvertently transports contaminants, such as dirt and abrasives adhered to worker shoes and construction equipment which eventually becomes lodged in the thresholds. Many of the thresholds are expensive and include finished surfaces applied during manufacturing (e.g., extruded finishes) which are difficult to repair if damaged.

Doorway manufacturers and installers are continually called in to repair the damage to thresholds caused during construction. New homeowners frequently complain of damage during move-in walkthrough inspections. Similarly if modifications to a building or its contents are made or heavy articles are to be rolled over the threshold during moving, the threshold will require protection from the through traffic.

In the relevant art, there are a number of inventions which attempt to protect the door thresholds. For example, U.S. Pat. No. 6,269,591 to Kelly discloses a threshold protective cover which includes removable sections for installation over varying threshold widths. In another invention to the same inventor, U.S. Pat. No. 6,216,395 discloses a one piece cover which is temporarily attached to the door threshold. Both of the Kelly patents teach an adhesive to maintain the cover in position over the threshold which requires time-consuming adhesive removal, adds height to the threshold making door closure difficult or impossible and inherently attaches grit due to the adhesive properties. Neither of the disclosed covers are readily adaptable to a sliding door track as their profile is specific to a hinged door threshold and are thus prone to displacement from their protective position. Lastly, neither of the Kelly inventions are likely to be repositioned over the door threshold if removed nor do they provide any affirmative reminder to be repositioned over the door threshold once removed.

What is needed is a protective cover that can be used over both hinged and sliding door thresholds, requires no modification to allow door closure, does not leave an adhesive residue on the surface to be protected, is easily situated into a protective position whenever the doorway is in use, allows door closure, is unlikely to be removed and provides an affirmative reminder to be repositioned over the door threshold.

SUMMARY OF THE INVENTION

Objects and Advantages

One object of this invention is to provide a device to protect a threshold of a door.

A second object of this invention is to provide a device that protects the door threshold while permitting closure of the door.

A third object of this invention is to provide a device that protects the threshold of a door which is not easily misplaced or removed.

A fourth object of this invention is to provide a device that provides an affirmative reminder to use the threshold protector.

A fifth object of this invention is to provide a device that is adaptable to protect a wide variety of threshold configurations.

A sixth object of this invention is to provide a device that protects a door threshold that is economical to manufacture, easy to install and use.

The present invention comprises a threshold protective cover which includes a hinge. The hinge allows the protective cover to be pivotally positioned over either a hinged or sliding door threshold to protect the underlying threshold during times of through traffic and repositioned away from the threshold when the door is to be closed. The threshold protective cover may be used during construction or modification of a building or its contents to protect the threshold from damage due to through traffic. The protective cover may also be used to protect door thresholds when heavy articles are rolled over the threshold, for example when furniture or other heavy objects are rolled out of the doorway on a dolly or hand truck.

In one embodiment of the invention, intended for outward swinging hinged doors and sliding doors, the protective cover is attached to a surface adjacent to a door threshold using screws, nails or adhesive tape and includes a hinge joined at or near a rear edge of the protective cover to allow pivoting of the protective cover along a lateral axis substantially parallel to the installed threshold. The hinge includes a fixed anchoring portion and a pivotal portion joined to the protective cover at the rear. The hinge allows pivoting rearward of the protective cover away from the threshold to permit closing of the door while the protective cover remains attached to the floor. This allows the protective cover to remain in place, ready to be repositioned over the door threshold when the door is reopened. When pivoted away (rearward) from the threshold (i.e., non-protecting position,) the protective cover protrudes upward, being substantially perpendicular to the threshold which provides an affirmative reminder to reposition the cover over the threshold.

The protective cover is comprised of a downward sloping top surface extending from a top end of a substantially vertical section to a front edge. The front edge includes a decurvate (downward facing) edge. The vertical section provides sufficient height to allow a guard portion (top and underside surfaces) to clear the highest vertical edge of an underlying threshold when in a protecting position. If necessary, a wooden shim or spacer may be installed beneath the fixed anchoring portion to adjust the vertical height of the protective cover.

A horizontal rear edge constructed of rigid polymeric materials extends rearward from a bottom end of the vertical section and is attached to an integral hinge. The integral hinge may be constructed from a flexible polymeric material or a rigid polymeric material when configured as a standard mechanical hinge. The fixed anchoring portion of the rigid polymeric material is attached to an opposite side of the integral hinge in parallel to the horizontal rear edge and allows rotation of the protective cover along a lateral axis.

The underside surface, vertical section and front edge defines an inverted channel which substantially encompasses the door threshold when situated in a protecting position and approximates the profile of the underlying threshold without substantial attachment thereto. A width of the threshold protector may be manufactured in varying sizes to allow protection of a wide variety of threshold arrangements or trimmed to fit a particular doorway.

In another embodiment of the invention, intended for inward swinging hinged doors, the protective cover is attached to an exterior surface of a building generally below and perpendicular to the threshold using screws, nails or adhesive tape, and if necessary, a wooden shim or spacer. The hinge is joined to the protective cover at or near a front edge to allow forward pivoting of the protective cover along a lateral axis substantially parallel to the installed threshold. The hinge includes a fixed anchoring portion and a pivotal portion joined at or near a front edge of the protective cover. The hinge allows pivoting of the protective cover away (forward) from the threshold (i.e., non-protecting position) to permit closing of the door while the protective cover remains attached to the exterior of the building. This allows the protective cover to remain in place, ready to be repositioned over the door threshold when the door is reopened.

When pivoted away (forward) from the threshold (i.e., non-protecting position) the protective cover protrudes upward, being substantially perpendicular to the threshold which provides an affirmative reminder to reposition the cover over the threshold.

The protective cover is comprised of a downward sloping top surface extending from a top end of a substantially vertical section to a front edge. The front edge includes a decurvate (downward facing) edge. The vertical section provides sufficient height to allow a guard portion (top and underside surfaces) to encompass a substantial portion of the underlying threshold when in a protecting position.

A substantially vertical attachment edge adjacent to the front edge of the guard extends downward from the underside surface. This vertical attachment edge is attached to the integral hinge. The integral hinge may be constructed from a flexible polymeric material or a rigid polymeric material when configured as a standard mechanical hinge. The fixed anchoring portion of the rigid polymeric material is attached to an opposite side of the integral hinge in parallel to the vertical attachment edge.

The underside surface, vertical section and vertical attachment edge defines an inverted channel which substantially encompasses the door threshold when situated in a protecting position and approximates the profile of the underlying threshold without substantial attachment thereto. A width of the threshold protector may be manufactured in varying sizes to allow protection of a wide variety of threshold arrangements or trimmed to fit a particular doorway.

BRIEF DESCRIPTION OF THE SEVERAL VIEWS OF THE DRAWINGS

The features and advantages of the invention will become apparent from the following detailed description when considered in conjunction with the accompanying drawings. Where possible, the same reference numerals and characters are used to denote like features, elements, components or portions of the invention. It is intended that changes and modifications can be made to the described embodiment without departing from the true scope and spirit of the subject invention as defined in the claims.

DETAILED DESCRIPTION OF THE INVENTION

The present invention comprises a threshold protective cover which includes a hinge. The hinge allows the protective cover to be pivotally positioned over either a hinged door or sliding door threshold to protect the underlying threshold during times of through traffic and repositioned away from the threshold when a door is to be closed. The threshold protective cover may be used during construction or modification of a building or its contents to protect the threshold from damage due to through traffic. The protective cover may also be used to protect door thresholds when heavy articles are rolled over the threshold, for example when furniture or other heavy objects are rolled out of the doorway on a dolly or hand truck.

Two main embodiments of the invention are disclosed which allows the use of the invention for protecting thresholds associated with sliding doors, inward swinging hinged doors and outward swinging hinged doors. For thresholds associated with outward swinging hinged doors and sliding doors, the hinge is installed at or near the rear of the protective cover. For thresholds associated with inward swinging hinged doors, the hinge is located at or near the front of the protective cover.

Figure 1:
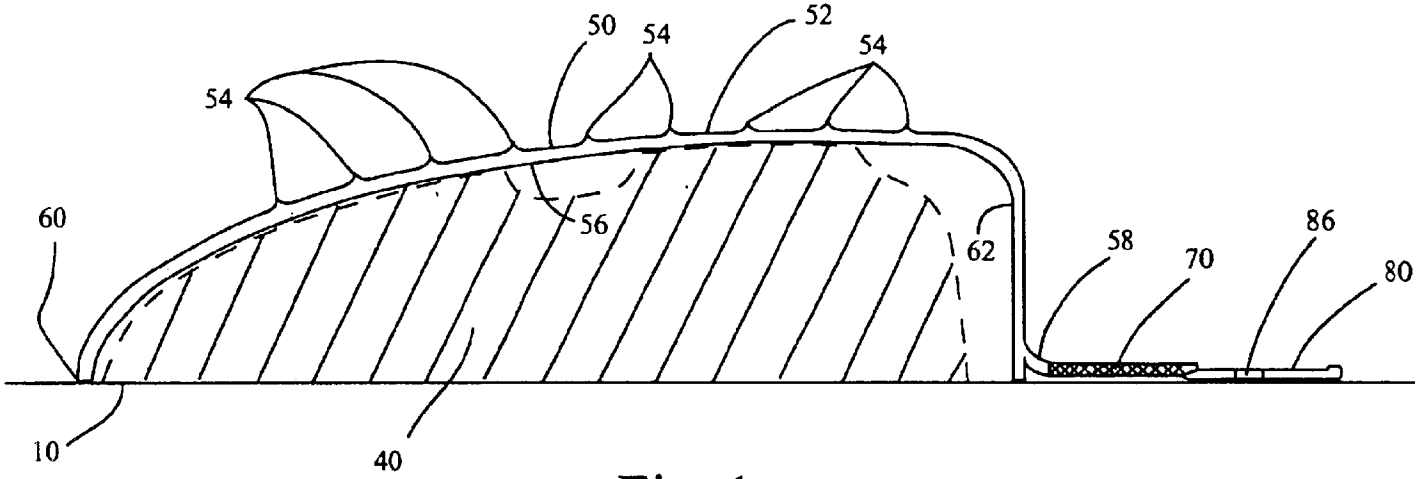
FIG. 1 is a side view of a first embodiment of a threshold protective cover invention intended for outward swinging hinged doors and sliding doors.

Referring to FIG. 1, a side view of a first embodiment of the invention is depicted which is intended for outward swinging hinged doors and sliding doors. The protective cover is comprised of a downward sloping top surface (50) having an underside surface (56) and a front edge (60), a substantially vertical section (62) attached at a top end to the top surface (50) and a hinge (70) attached to a rear edge (58) of the substantially vertical section (62). The top surface (50) may include a plurality of ridges (54) to provide a non-skid and/or non-slip surface.

The top surface (50), underside surface (56), vertical section (62) and the front edge (60) comprises a guard portion of the protective cover. The vertical section (62) provides sufficient height to allow the guard portion to clear a highest vertical edge of an underlying threshold (40) when in a protecting position. If necessary, a wooden shim or spacer may be installed beneath a fixed anchoring portion (80) to adjust the vertical height of the protective cover.

The substantially vertical section (62) includes the rearward facing rear edge (58) extending essentially horizontally from a bottom end of the substantially vertical section (62) from which the hinge (70) is attached. In this embodiment of the invention, the top (50) and underside surfaces (56), include a slightly decurvate (downward facing) profile to conform to a profile of the threshold (40.) The front edge (60) may also include a decurvate profile.

Depending on the dimensions of the threshold (40) to be protected, the underside surface (56) may either rest upon the threshold (40) or spans a width of the threshold (40) such that the underside surface (56,) the substantially vertical section (62) and the front edge (60) defines an inverted channel which substantially encompasses the threshold (40) when the guard portion is situated in a protecting position, which approximates the profile of the underlying threshold (40) and without substantial attachment thereto.

The hinge (70) is attached to one side of the rear edge (58) and includes the fixed anchoring portion (80) attached to an opposite side of the hinge (70). In an alternate embodiment of the invention, the fixed anchoring portion (80) is a separate anchoring strip constructed of rigid polymeric material which is joined to the hinge (70.) The width of the pivoting portion of the hinge (70) may be varied to allow installation and protection of a wide range of door thresholds (40.) For example, a range of 0.5 to 5.0 inches will allow installation over most threshold encountered. Also, when integrated into a door threshold (40) by a door manufacturer, the fixed anchoring portion (80) may be omitted.

The fixed anchoring portion (80) allows attachment of the hinge (70) to a surface (10) adjacent to the threshold (40) such as a floor (10), usually by fasteners such as nails or screws. The fasteners may be inserted through a plurality of optional pre-drilled attachment holes (86) or simply pierce through the fixed anchoring portion (80) using a nail or screw gun. If necessary, a wooden shim or spacer may be installed beneath the fixed anchoring portion to adjust the vertical height of the protective cover.

In another embodiment of the invention, the fixed anchoring portion (80) may be attached to the surface (10) using adhesive, including releasable adhesives. The selection of fastening methods is based on the type of horizontal surface (10) adjacent to the threshold (40) (e.g., finished or unfinished) and the preferences of an installer. The hinge (70) may be either a standard interleaving mechanical type or constructed from flexible polymeric materials and integral to the protective cover. In another embodiment of the invention, the hinge (70) may be attached directly to the threshold (40) by a threshold manufacturer and removed when no longer required to protect the threshold.

The protective cover is installed adjacent to a threshold (40) with a long dimension of the fixed anchoring portion (80) aligned generally in parallel to a long dimension of the threshold (40) to be protected. Where necessary, the protective cover may be trimmed using a saw, shears or other cutting means to fit an unusually shaped doorway or threshold.

The top surface (50), underside surface (56), front edge (60), substantially vertical section (62), rear edge (58) and fixed anchoring portion (80) are constructed from rigid PVC and the hinge (70) constructed from flexible PVC which is attached to the rear edge (62) and fixed anchoring portion (80.) Examples of suitable construction materials for all embodiments of the invention include flexible PVC having a range of 60–80 durometers in hardness for the flexible portion of the hinge and rigid PVC having properties similar to PolyOne™ Geon® 87180 for all other portions of the protective cover. In all embodiments of the invention in which polymeric construction materials are used, wall thicknesses as measured between the top (50) and underside (56) surfaces range between 0.03 inches to 0.25 inches.

It should be appreciated by one skilled in the art that the protective cover may be manufactured in a variety of lengths and widths to accommodate a wide variety of threshold and doorway configurations using a wide variety of commonly available polymeric materials, composite fiber materials or lightweight metals such as polyvinyl chloride (PVC), high strength cardboard or aluminum.

Figure 2:
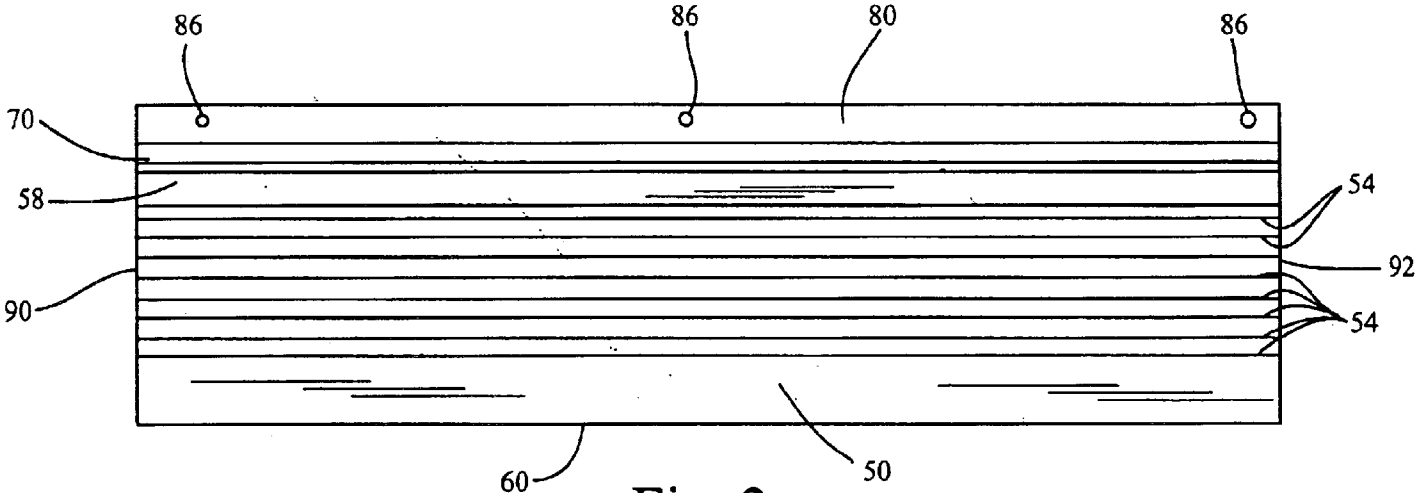
FIG. 2 is a top view of the first embodiment of the threshold protective cover invention intended for outward swinging hinged doors and sliding doors.

Referring to FIG. 2, a top view of the first embodiment of the invention is depicted showing the top surface (50), the front edge (60), the plurality of ridges (54), the integral hinge (70), the rear edge (58), a left edge (90) of the top surface, a right edge (92) of the top surface, the plurality of pre-drilled attachment holes (86) and the fixed anchoring portion (80.)

Figure 3:
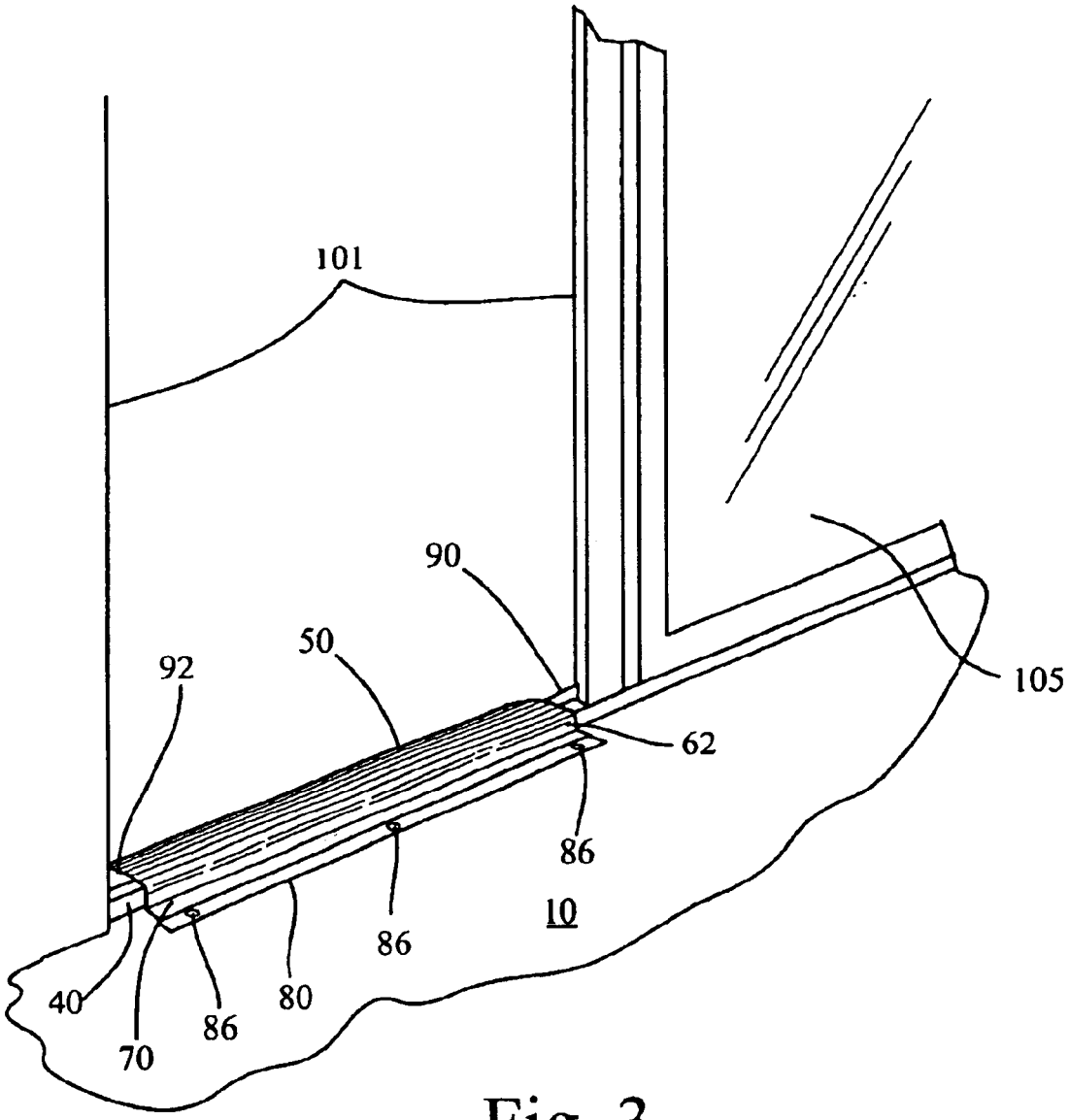
FIG. 3 is a perspective view of the first embodiment of the threshold protective cover invention depicting an open sliding door with the guard portion of the invention shown in a protecting position.

Referring to FIG. 3, a perspective view of the first embodiment of the invention is depicted showing the invention installed with the guard in a protecting position over the threshold (40). Prior to attaching the fixed anchoring portion (80) to a surface (10), the door (105) is opened and the guard is placed over the threshold (40) in the protecting position, to assure that the protective cover is properly aligned within a doorway (101).

Figure 4:
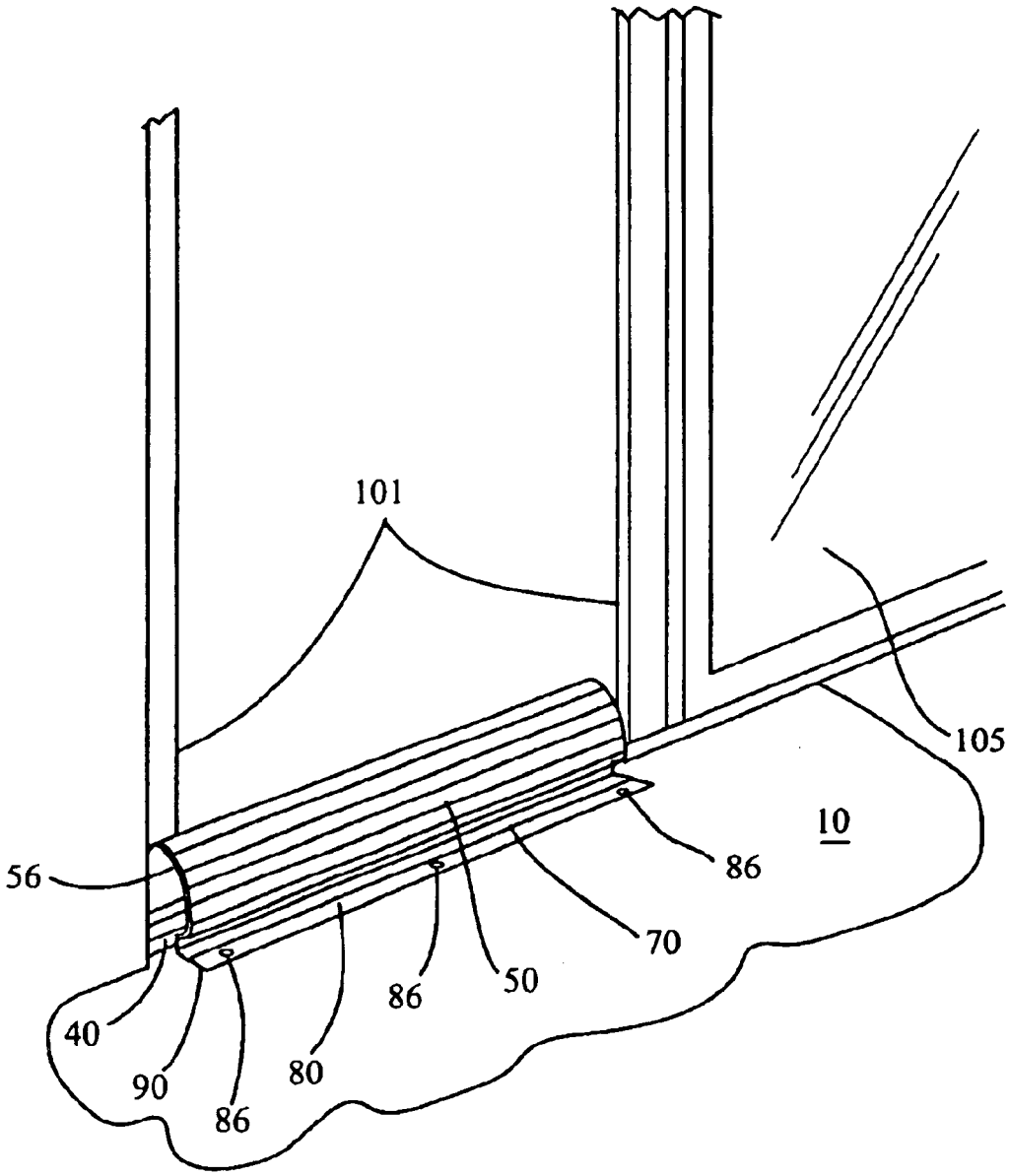
FIG. 4 is another perspective view of the first embodiment of the threshold protective cover invention depicting the guard portion of the invention in a non-protecting position which allows door closure while remaining available to protect the door threshold when the door is reopened.

Referring to FIG. 4, another perspective view of the first embodiment of the invention is depicted showing the invention installed and the guard raised in a non-protecting position where the top surface (50) and underside surface (56) provides an affirmative reminder to a user attempting to access or egress the doorway (101) to reposition the protective cover to the protecting position over the threshold (40). Additionally, when the guard is situated in this non-protecting position, the door (105) may be closed without interference. The invention is then available to be repositioned to the protecting position when the door (105) is re-opened.

Figure 5:
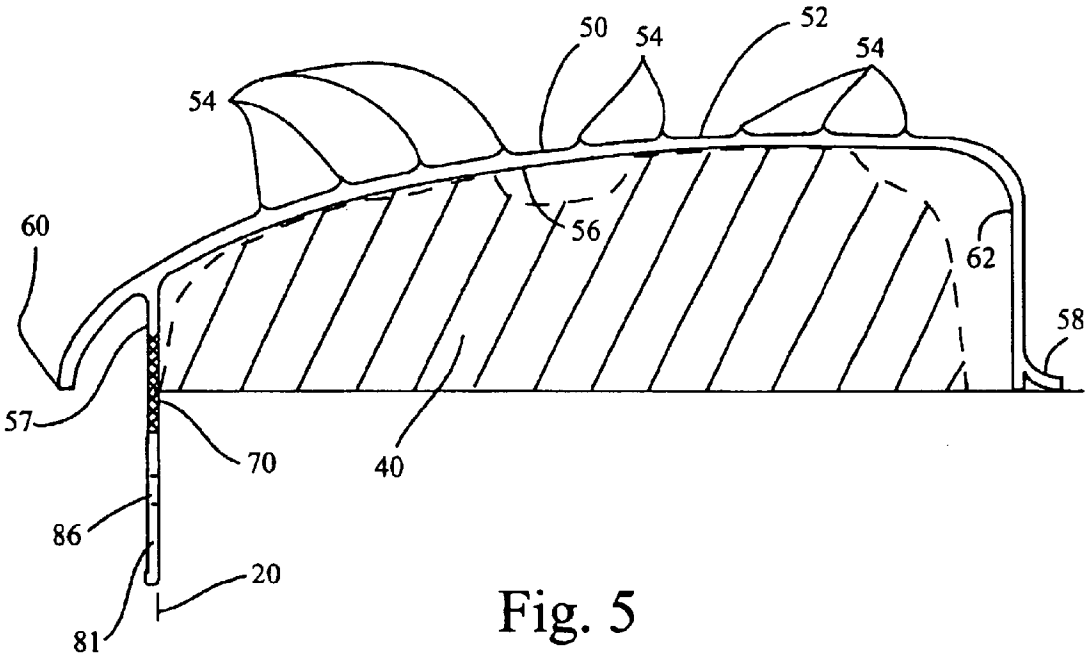
FIG. 5 is a side view of a second embodiment of the threshold protective cover invention intended for inward swinging hinged doors.

Referring to FIG. 5, a side view of a second embodiment of the invention is depicted which is intended for inward swinging hinged doors. The only significant difference between this embodiment of the invention and the first embodiment of the invention is that the hinge (70) is installed at or near the front edge (60) of the protective cover. In this embodiment of the invention, the protective cover is comprised of the downward sloping top surface (50) having the underside surface (56) and the front edge (60), the substantially vertical section (62) attached at the top end to the top surface (50), a vertical attachment edge (57) extending downward from the underside (56) and situated adjacent to the front edge (60) and a vertically oriented hinge (70) attached to the vertical attachment edge (57.) The top surface (50) may include the plurality of ridges (54) to provide a non-skid and/or non-slip surface.

The top surface (50), underside surface (56), vertical attachment edge (57) and downward extending vertical section (62) comprises a guard portion of the protective cover. The hinge (70) is attached to a bottom of the vertical attachment edge (57) on one side of the hinge and to a fixed anchoring portion (81) on an opposite side of the hinge (70). The hinge (70) may be either a standard interleaving mechanical type or constructed from flexible polymeric materials. The fixed anchoring portion (81) may be a separate anchoring strip which is joined to the hinge (70) when the hinge is constructed of a flexible polymeric material.

The fixed anchoring portion (81) allows attachment of the hinge (70) to an exterior surface (20) generally below and perpendicular to a threshold (40) to be protected. If required, a wooden spacer or shim may be installed between the hinge (70) and the exterior surface (20) to allow the hinge (70) to freely pivot over the threshold (40). As before, the fasteners may be inserted through a plurality of optional pre-drilled attachment holes (86) or simply pierce through the fixed anchoring portion (80). The fixed anchoring portion (81) may be attached to the exterior surface (20) using adhesive, including releasable adhesives. The selection of fastening methods is based on the type of exterior surface (20) adjacent to the threshold (40) (e.g., finished or unfinished) and the preferences of an installer.

The protective cover is installed on an exterior surface (20) generally below and adjacent to the threshold (40) with a long dimension of the fixed anchoring portion (80) aligned generally in parallel to the exterior surface (20). Again, where necessary, the protective cover may be trimmed using a saw, shears or other cutting means to fit an unusually shaped doorway or threshold. The top surface (50), underside surface (56), front edge (60), substantially vertical section (62), vertical attachment edge (57) and fixed anchoring portion (81) are constructed from rigid PVC and the hinge (70) constructed from flexible PVC which is attached to the vertical attachment edge (57) and fixed anchoring portion (81.)

The underside surface (56), substantially vertical section (62) and vertical attachment edge (57) defines an inverted channel which substantially encompasses the door threshold (40) when situated in a protecting position and which approximates the profile of the underlying threshold (40.) A width of the threshold protector may be manufactured in varying sizes to allow protection of a wide variety of threshold arrangements or trimmed to fit a particular doorway.

Figure 6:
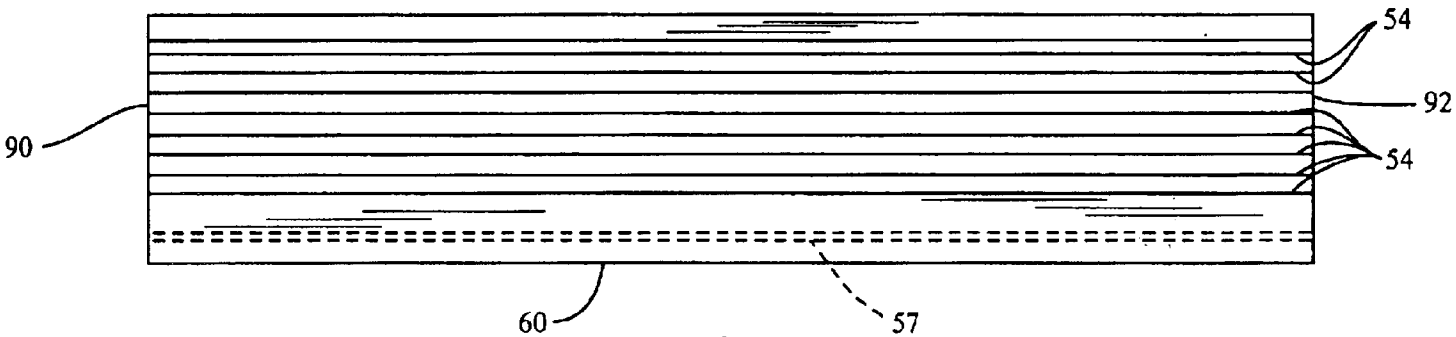
FIG. 6 is a top view of the second embodiment of the threshold protective cover invention intended for inward swinging hinged doors.

Referring to FIG. 6, a top view of the second embodiment of the invention is depicted showing the top surface (50), the front edge (60), the plurality of ridges (54), a left edge (90) of the top surface, a right edge (92) of the top surface and the plurality of pre-drilled attachment holes (86). The substantially vertical section (62), the integral hinge (70) and the fixed anchoring portion (81) are hidden beneath the protective cover. The dotted lines indicate a top of the vertical attachment edge (57).

Figure 7:
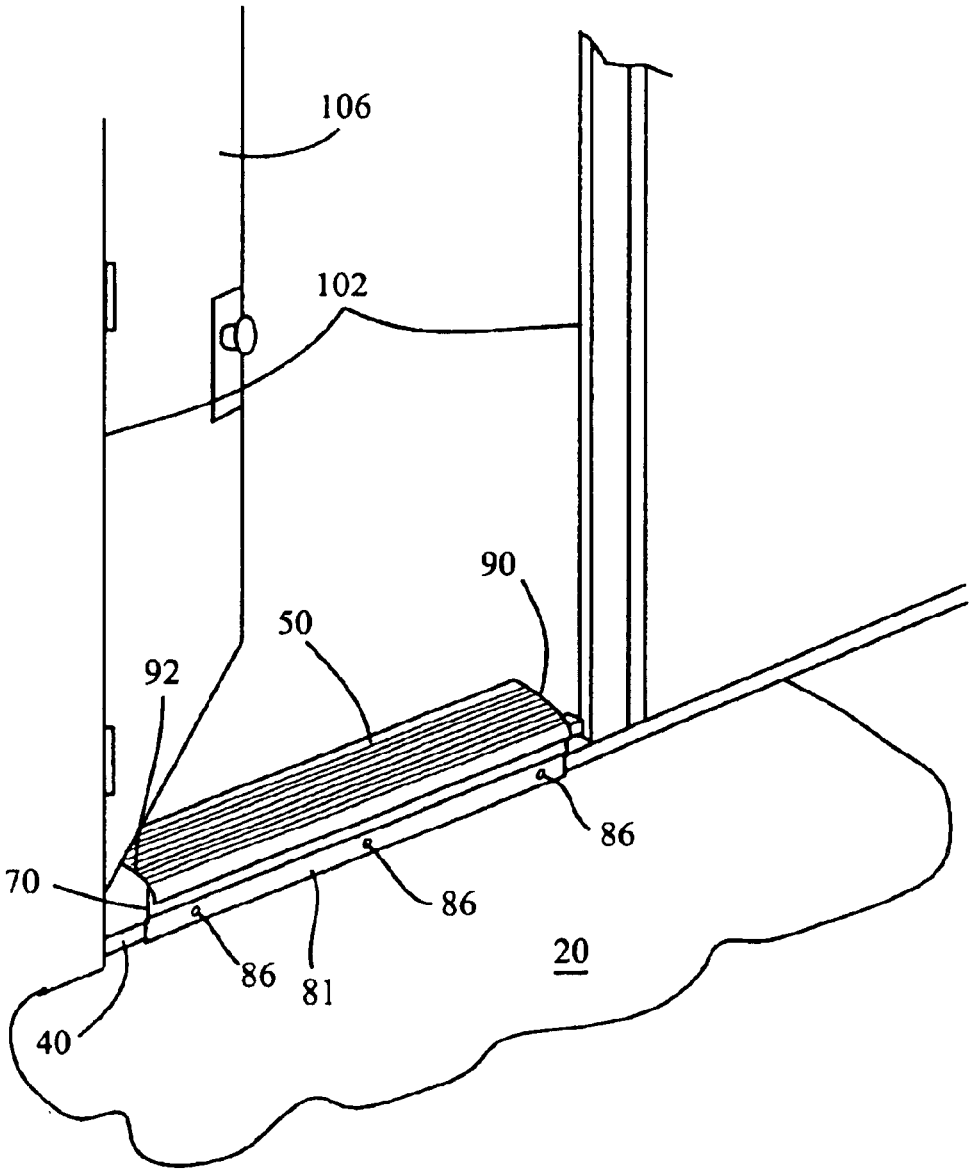
FIG. 7 is a perspective view of the second embodiment of the threshold protective cover invention depicting an open inward swinging hinged door with the guard portion of the invention shown in a protecting position.

Referring to FIG. 7, a perspective view of the second embodiment of the invention is depicted showing the invention installed with the guard portion in a protecting position over the threshold (40) of an inward swinging hinged door. Prior to attaching the fixed anchoring portion (81) to the exterior surface (20), the door (106) is opened and the guard portion is placed over the threshold (40) in the protecting position, to assure that the protective cover is properly aligned within a doorway (102).

Figure 8:
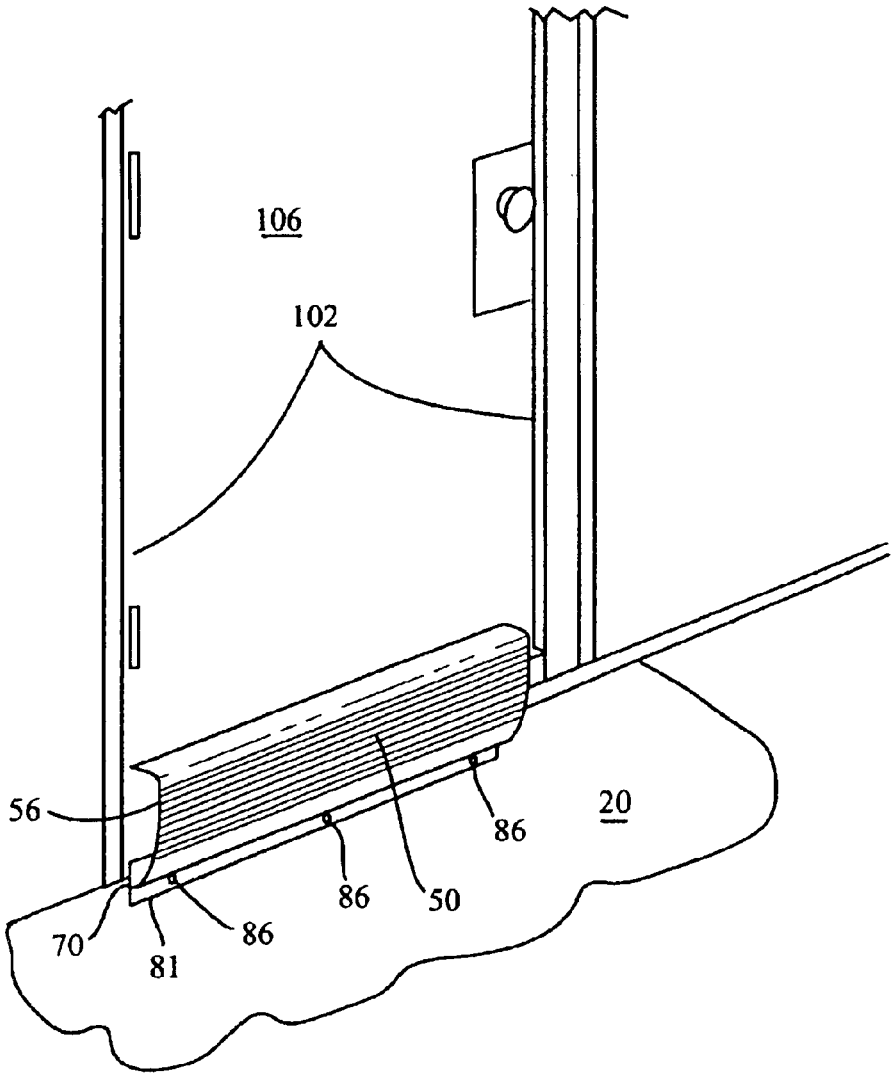
FIG. 8 is another perspective view of the second embodiment of the threshold protective cover invention depicting the guard portion of the invention in a non-protecting position for an open inward swinging hinged door, which allows door closure while remaining available to protect the door threshold when the door is reopened.

Referring to FIG. 8, another perspective view of the second embodiment of the invention is depicted showing the invention installed and the guard raised in a non-protecting position where the top surface (50) and the underside surface (56) provides an affirmative reminder to a user attempting to access or egress the doorway (102) to reposition the protective cover to the protecting position over the threshold (40). Additionally, when the guard is situated in this non-protecting position, the door (106) may be closed without interference. The invention is then available to be repositioned to the protecting position when the door (106) is re-opened.

It should be appreciated by one skilled in the art that the fixed anchoring portion (80) described in the first embodiment of the invention and the fixed anchoring portion (81) described in an alternate embodiment of the invention may be attached to a mounting surface by simply rotating the hinge portion until it is substantially parallel to the intended mounting surface. The mounting surface may be horizontal, slanted or vertical.

OPERATION

The threshold protective cover is installed by first opening the door of the doorway to be protected. Depending on the type of door, (outward swinging hinged door, sliding door or inward swinging hinged door,) the appropriate threshold protector is selected. The length of the door threshold or track is measured and if the protector is too long to fit, may be cut to fit the long dimension within the doorway. Adjustments to the vertical height or pivoting arc may be made by positioning wooden spacers or shims between the fixed anchoring portion and the intended mounting surface.

The guard of the threshold protector is positioned over the door threshold and the fixed anchoring portion is attached to a planar surface proximate to the threshold. If it is desired to close the door, the guard is positioned out of the way of the door and the door closed. If desired to use the doorway again, the door is opened and the guard is repositioned over the door threshold.

The foregoing described embodiments of the invention are provided as illustrations and descriptions. They are not intended to limit the invention to precise form described. In particular, it is contemplated that functional implementation of the invention described herein may be implemented using different construction materials hinge mechanisms and hinge attachment locations. Other variations and embodiments are possible in light of above teachings, and it is not intended that this Detailed Description limit the scope of invention, but rather by the Claims following herein.

What is claimed:

1. A hinged protective cover for protecting a door threshold comprising:

a guard portion including;

a downward sloping top surface extending from a top end of a substantially vertical section to a front edge, and an underside surface of said top surface, wherein said underside surface, said vertical section and said front edge defines therein an inverted channel which substantially encompasses said door threshold when situated in a protecting position but without substantial attachment thereto; and a hinge means joined to said protective cover.

2. The hinged protective cover according to claim 1 further including a rearward facing rear edge extending essentially horizontally from said bottom end of said substantially vertical section.

3. The hinged protective cover according to claim 2 wherein said hinge means is joined to said rear edge.

4. The hinged protective cover according to claim 1 further including a vertical attachment edge extending downward from said underside surface and situated adjacent to said front edge.

5. The hinged protective cover according to claim 4 wherein said hinge means is joined to said vertical attachment edge.

6. The hinged protective cover according to claim 1 wherein said hinge means includes means for attaching said hinge means to a mounting surface in proximity to said threshold.

7. The hinged protective cover according to claim 6 wherein said hinge means allows pivoting of said guard portion along a lateral axis substantially in parallel to said threshold such that said underside surface is generally parallel to said threshold when situated in said protecting position.

8. The hinged protective cover according to claim 6 wherein said hinge means allows pivoting of said guard portion along said lateral axis substantially in parallel to said threshold such that said underside surface is generally perpendicular to said threshold when situated in a non-protecting position.

9. The hinged protective cover according to claim 6 wherein said mounting surface is a planar surface in said proximity to said threshold but generally apart therefrom.

10. The hinged protective cover according to claim 1 wherein said front edge includes a decurvate profile.

11. The hinged protective cover according to claim 1 wherein said top surface includes a slight decurvate profile.

12. The hinged protective cover according to claim 1 wherein said top surface includes a plurality of lateral ridges.

13. The hinged protective cover according to claim 1 wherein at least a substantial portion of said protective cover is constructed from a rigid polymeric material.

14. The hinged protective cover according to claim 1 wherein at least a portion of said hinge means is constructed from a flexible polymeric material.

15. The hinged protective cover according to claim 1 wherein said hinge means is a mechanical hinge.

16. The hinged protective cover according to claim 1 wherein said hinge means includes a fixed anchoring portion.

17. The hinged protective cover according to claim 16 wherein said fixed anchoring portion include means for attaching said hinge means to a mounting surface to allow rotation of said cover along a lateral axis.

18. A hinged protective cover for protecting a door threshold comprising:

a guard portion including;

a top surface extending from a top end of a rear vertical section to a front edge and an underside surface of said top surface, such that said underside surface, said vertical section and said front edge defines therein an inverted channel which substantially encompasses said building door threshold when situated in a protecting position; and, a hinge means joined to said protective cover but separate from said door threshold which allows at least said guard portion to be pivoted from said protecting position to a non-protecting position.

* * * * *